US011854515B1

(12) United States Patent
Zales

(10) Patent No.: US 11,854,515 B1
(45) Date of Patent: Dec. 26, 2023

(54) HI-HAT DRUM PEDAL

(71) Applicant: Lelan Zales, Los Angeles, CA (US)

(72) Inventor: Lelan Zales, Los Angeles, CA (US)

( * ) Notice: Subject to any disclaimer, the term of this patent is extended or adjusted under 35 U.S.C. 154(b) by 0 days.

(21) Appl. No.: 17/680,096

(22) Filed: Feb. 24, 2022

Related U.S. Application Data

(60) Provisional application No. 63/154,614, filed on Feb. 26, 2021.

(51) Int. Cl.
*G10D 13/11* (2020.01)
*G10D 13/065* (2020.01)

(52) U.S. Cl.
CPC ..... *G10D 13/11* (2020.02); *G10D 13/065* (2013.01)

(58) Field of Classification Search
CPC ..... G10D 13/11; G10D 13/065
See application file for complete search history.

(56) References Cited

U.S. PATENT DOCUMENTS 1,570,167 A * 1/1926 Mortensen ..... G10D 13/11 84/422.1
2,484,302 A * 10/1949 Laverents ..... G10D 13/11 84/422.1
3,988,957 A * 11/1976 Escamilla ..... G10D 13/11 84/422.1
5,355,761 A * 10/1994 Ward ..... G10D 13/065 84/422.2
5,458,039 A * 10/1995 Ashby ..... G10D 13/11 84/422.1
5,866,830 A * 2/1999 Onyszkanycz ..... G10D 13/11 84/422.1
6,002,076 A * 12/1999 Karn ..... G10D 13/11 84/422.4
6,087,573 A * 7/2000 Falliex ..... G10D 13/11 84/422.1
6,541,686 B2 * 4/2003 O'Donnell ..... G10D 13/11 84/422.1
7,074,997 B2 * 7/2006 Steele ..... G10D 13/11 84/422.1
7,115,805 B1 * 10/2006 Vandervoort ..... G10D 13/065 84/422.1
8,969,697 B2 * 3/2015 Hamilton, II ..... G10D 13/11 84/422.1
9,378,712 B2 * 6/2016 Owen ..... G10D 13/11
9,595,247 B2 * 3/2017 Benner, Jr. ..... G10D 13/11
10,235,979 B1 * 3/2019 Sato ..... G10D 13/065

* cited by examiner

*Primary Examiner* — Robert W Horn

(57) ABSTRACT

Systems and methods for monitoring non-use of personal electronic devices are disclosed. Connection of a personal electronic device to a charging circuit is detected and identified to a particular personal electronic device. Connections of each personal electronic device are aggregated and rendered to a display to provide feedback and gamification of periods of non-use of the personal electronic devices. Gamification is employed to promote non-use of the personal electronic devices.

6 Claims, 7 Drawing Sheets

HI-HAT DRUM PEDAL

BACKGROUND OF THE INVENTION

A hi-hat device is a device typically operated by a toe pedal for moving a movable cymbal into contact with a stationary cymbal. Playing the device requires repetitive presses of the toe.

BRIEF SUMMARY OF THE INVENTION

My invention involves an improved design for the pedal device of a hi-hat percussion instrument.

The hi-hat is made operable with a design that incorporates an additional pedal on the back of the standard hi-hat. This allows the users heel to press the pedal down to activate the forward movement of the linkage enabling the rod to allow the hi-hat cymbals to open and close. This design allows the user to use less physical force to play the hi-hat.

BRIEF DESCRIPTION OF THE SEVERAL VIEWS OF THE DRAWINGS

FIG. 2 is a the left side view there of.

DETAILED SPECIFICATION

Figure 1:
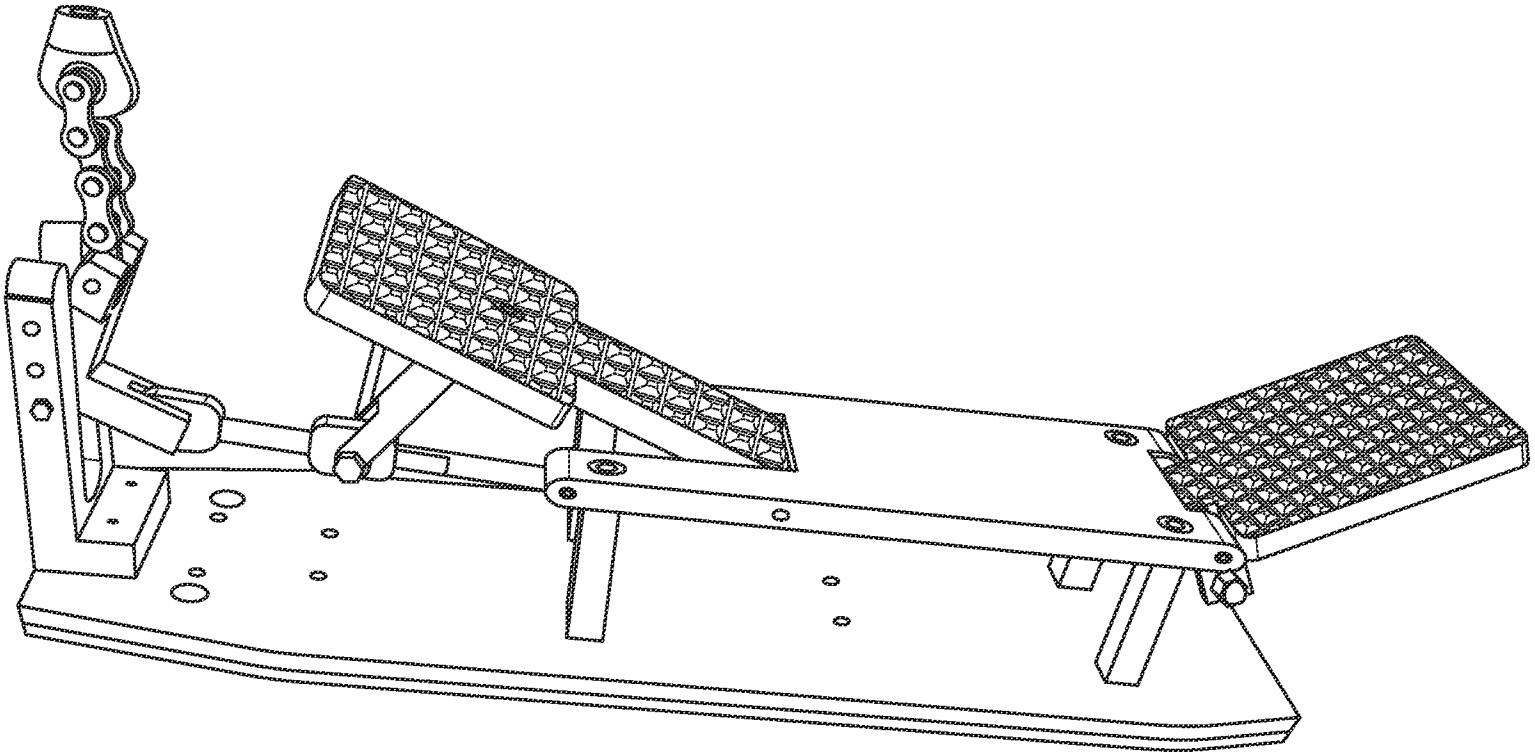
FIG. 1 is a top view of new hi-hat design.

FIG. 1 shows the details of the claimed invention including a stationary base for supporting the pedal device on a surface and a stationary platform supported by four stanchions extending from the base to the platform, the platform for supporting the center of the user's foot, and a first pedal pivotable by a hinge at the heel side of the platform.

Figure 2:
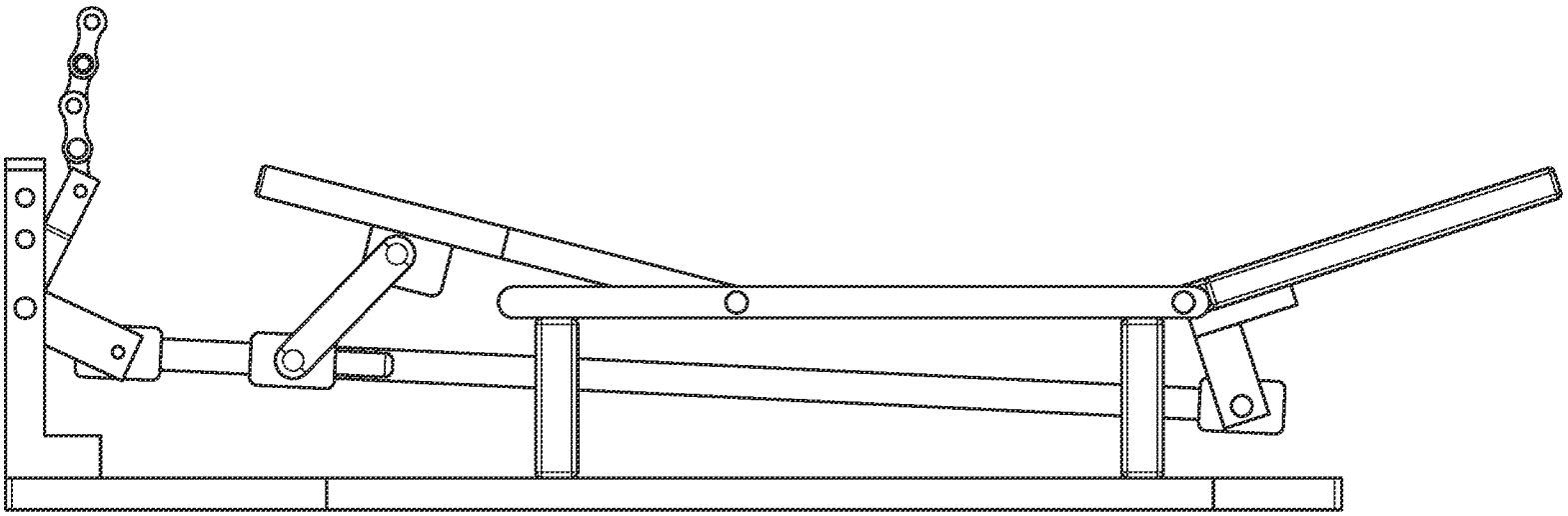

FIG. 2 shows the first pedal having one or two extending bars and a through-hole and an actuator rod mounted to the bar(s) of the heel pedal by a pivot area on the rod.

FIG. 2 also shows the rod being elongate and extending under the platform, having a second end adjacent the toe end of the platform. At the end of the rod, a second pedal is mounted pivotally within a slot at the toe end of the platform, as shown in FIG. 1.

Figure 3:
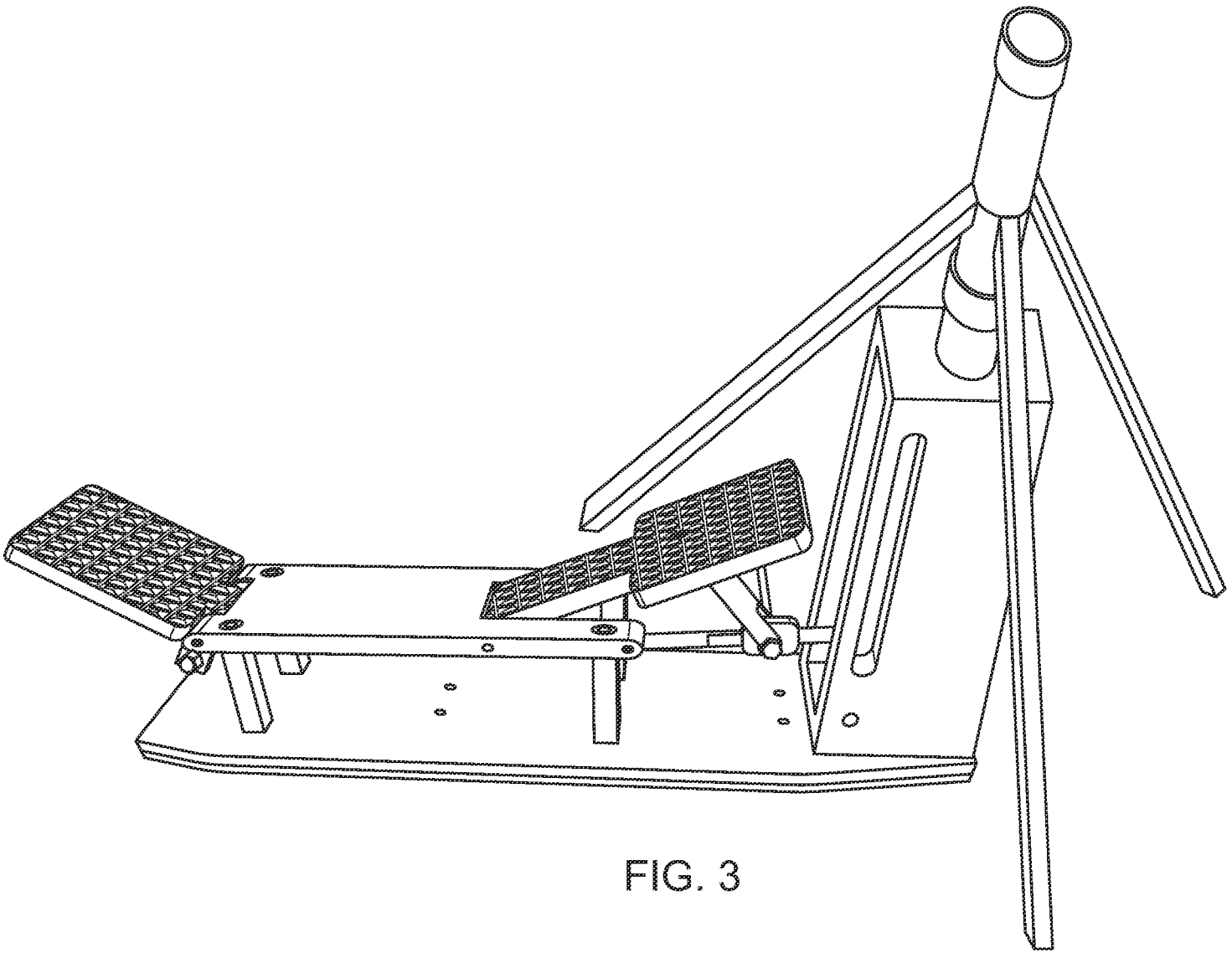
FIG. 3 is a right side view there of with the connecting tripod stand.
Figure 4:
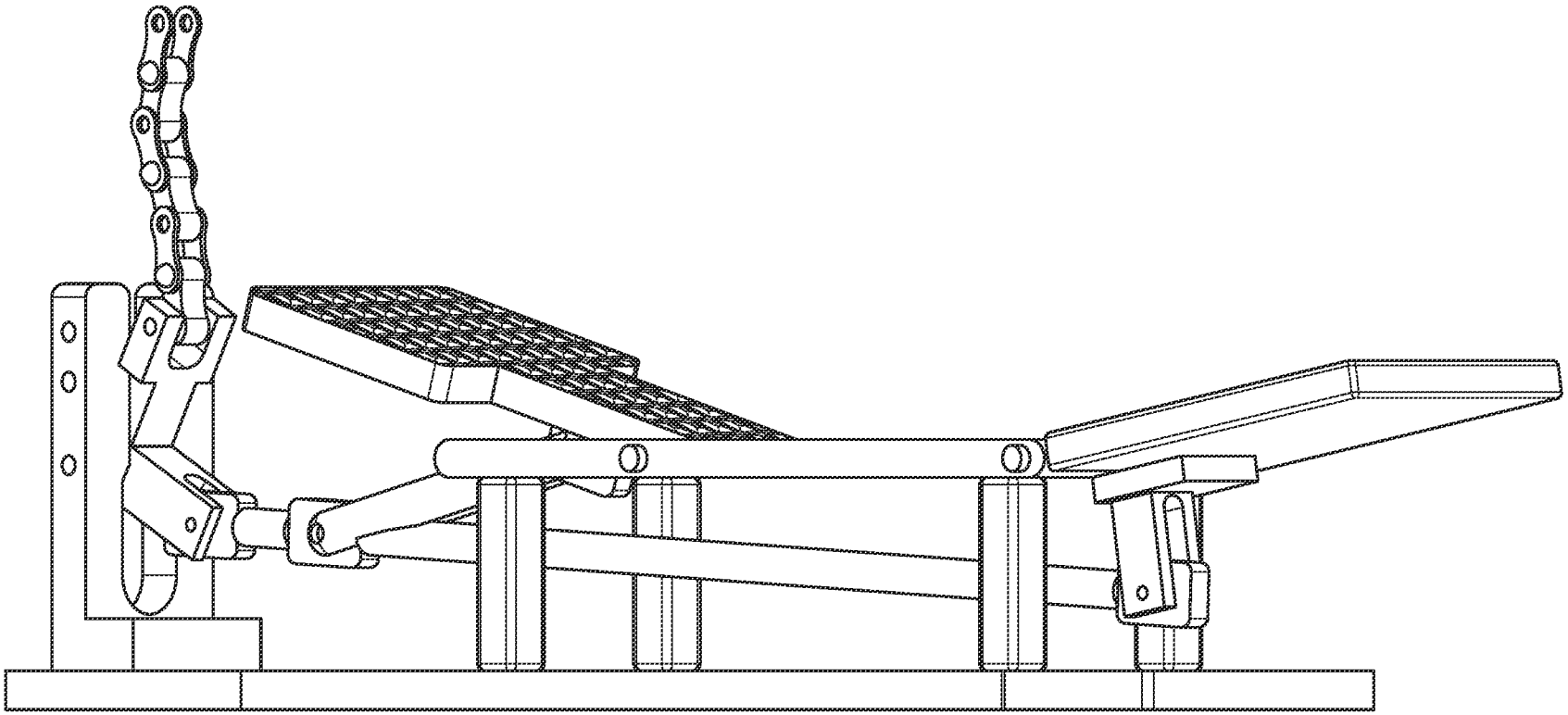
FIG. 4 is a left side view there of showing the connecting linkage of front and rear pedals.
Figure 5:
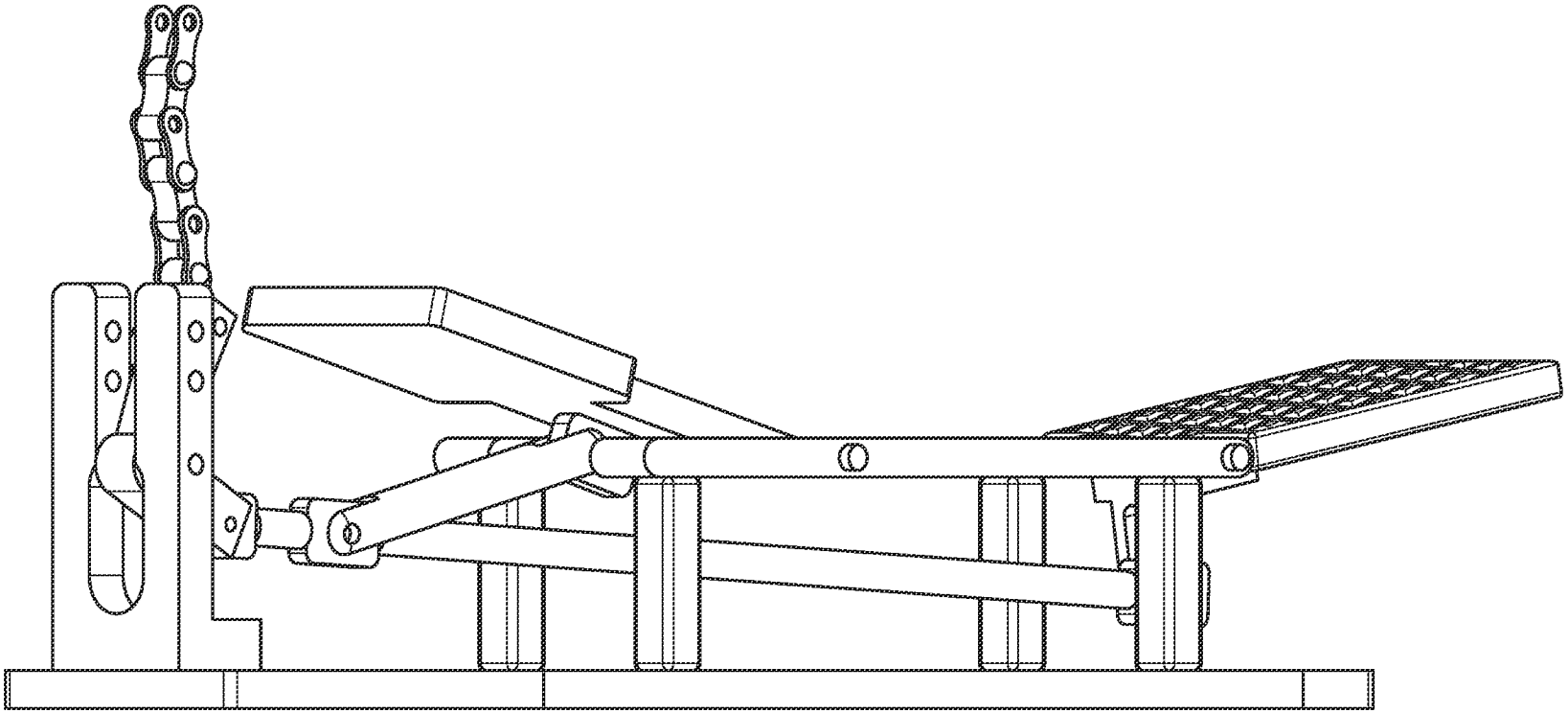
FIG. 5 is a left side view there of showing the connecting linkage.
Figure 6:
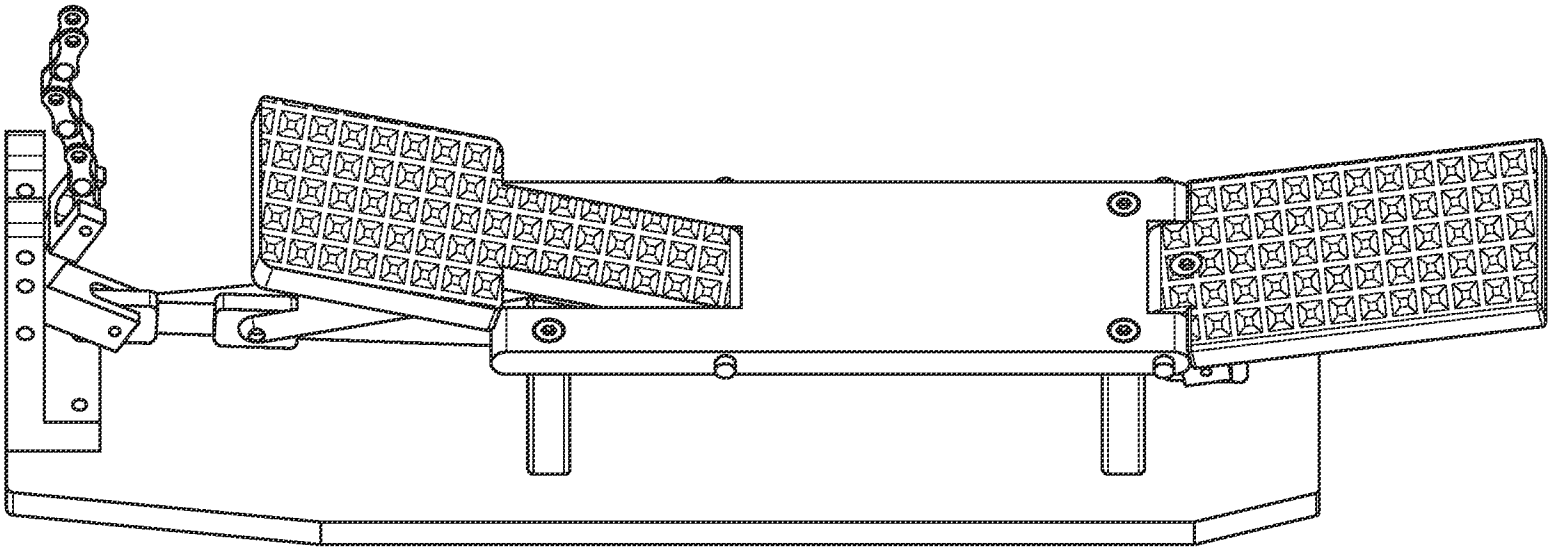
FIG. 6 is a top view there of showing both front and rear pedals.
Figure 7:
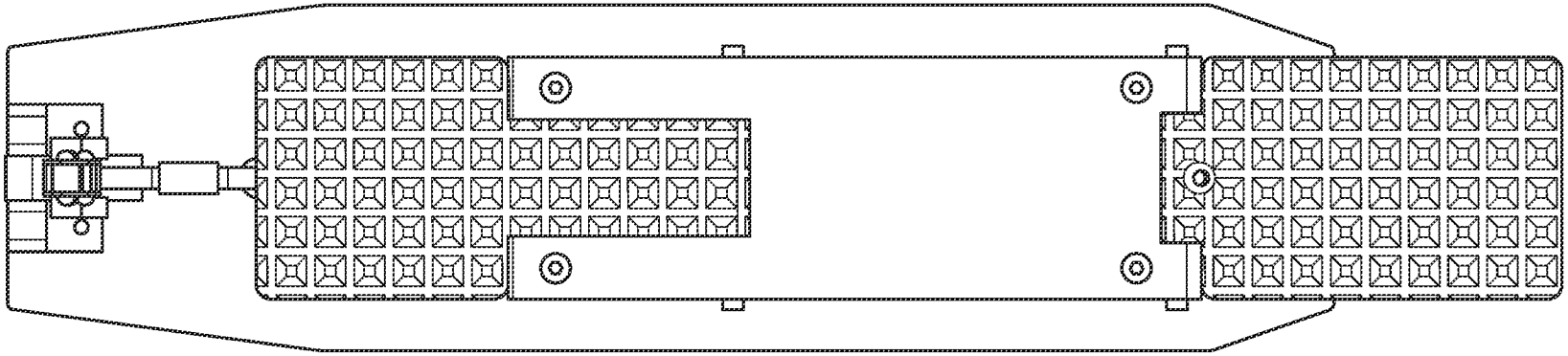
FIG. 7 is a top view thereof.

FIGS. 2-4 show the second pedal having a pivot mount on the back side the pedal, and one or two bars extending from the pivot mount on the pedal to a second pivot area at the second end of the rod, where the bar(s) can pivot at each end.

The rod links the motion of the heel pedal and the toe pedal, so the pedal linkage can be moved by either heel or toe one of the first and second pedals.

FIGS. 2, 4, 5 and 6 show a further extending rod portion for connecting to a linkage to a percussion device. The pedal device is configured wherein the user can alternately press the first pedal or the second pedal for actuating the linkage to the percussion device.

FIG. 3 shows the pedal device connected to a hi-hat stand, where the hi-hat percussion device is not shown.

FIGS. 2, and 4-6 show the details of the linkage of the rod to a stanchion, a pivoting L-shaped member, and chain for connecting to the movable rod in a hi-hat device.

FIGS. 1, 3, 6 and 7 show a grip pattern formed on each of the first and second pedals.

The invention claimed is:

1. A pedal device for a hi-hat stand, comprising a stationary base for supporting the pedal device on a surface;

a stationary platform supported by four stanchions extending from the base to the platform, the platform for supporting the center of the user's foot;

a first pedal pivotable by a hinge at the heel side of the platform, the first pedal having one or two extending bars and a through-hole;

an actuator rod mounted to the bar(s) of the heel pedal by a pivot area on the rod, the rod being elongate extending under the platform, having a second end adjacent the toe end of the platform;

a second pedal mounted pivotally within a slot at the toe end of the platform, the second pedal having a pivot mount on the back side the pedal;

one or two bars extending from the pivot mount on the pedal to a second pivot area at the second end of the rod, where the bar(s) can pivot at each end;

a further extending rod portion for connecting to a linkage to a percussion device, wherein the user can alternately press the first pedal or the second pedal for actuating the linkage to the percussion device.

2. The pedal device of claim 1, wherein the linkage for the percussion device comprises:

an extended part of the base, on which is mounted a base and one or two stanchions;

the stanchion(s) comprise a pivot axis formed of a hole positioned above the base;

one or two L-shape bars mounted at the corner of the L-shape to the stanchion axis, where a first leg of the L-shape is mounted pivotally to the further extending rod portion and a second leg of the L-shape is mounted to the downward extending linkage of the percussion device;

where pressing either the first or second pedal pivots the L-shaped member(s) and pulls downward on the linkage.

3. The pedal device of claim 2, wherein the device further comprises a hi-hat cymbal percussion device, where the upwardly extending linkage of the pedal device is connected to the rod for pulling the rod of the upper, movable cymbal of the device into contact with the lower stationary cymbal.

4. The pedal device of claim 1, wherein each of the first and second pedal top surfaces comprises a grip pattern.

5. The pedal device of claim 1, wherein the bass and platform each have a pattern of four holes for receiving fasteners, for mounting to mount holes at each end of the platform support stanchions.

6. The pedal device of claim 3 wherein the hi-hat device comprises a tripod stand, the stand comprising at least 3 legs extending outwardly from the tripod stand and the hi-hat support rod.

* * * * *